United States Patent [19]

Fazio et al.

[11] Patent Number: 4,982,963

[45] Date of Patent: Jan. 8, 1991

[54] GOLF CLUB SWING TRAINING DEVICE

[75] Inventors: Jerry J. Fazio, Williamsburg; E. Wayne Jackson, III, Zanoni, both of Va.; David E. Legere, West Palm Beach, Fla.

[73] Assignee: Swing Maker, Incorporated, Williamsburg, Va.

[21] Appl. No.: 311,973

[22] Filed: Feb. 17, 1989

[51] Int. Cl.[5] ..... A63B 69/36

[52] U.S. Cl. ..... 273/186 A; 273/186 R; 273/193 R; 273/80 B; 273/81.2; 273/81.4; 206/315.1

[58] Field of Search ..... 206/315.1; 273/186 R, 273/186 A, 80 B, 185 R, 186 C, 193 R, 193 A, 193 B, 194 R, 194 A, 194 B, 81.2, 186 D, DIG. 24

[56] References Cited

U.S. PATENT DOCUMENTS

| | | | |
|---|---|---|---|
| 1,662,712 | 3/1928 | Mensing | 273/80 B |
| 2,002,108 | 5/1935 | Child | 273/186 |
| 2,388,463 | 11/1945 | Benecke | 273/186 A |
| 3,229,980 | 1/1966 | Silberman | 273/186 A |
| 3,428,325 | 2/1969 | Atkinson | 273/186 A |
| 3,519,270 | 7/1970 | Baymiller | 273/80 B |
| 3,649,028 | 3/1972 | Worrell | 273/186 A |
| 3,649,029 | 3/1972 | Worrell | 273/186 A |
| 3,936,055 | 2/1976 | Scott | 206/315.1 |
| 4,118,033 | 10/1978 | Miyamoto | 273/186 C |
| 4,239,227 | 12/1980 | Davis | 273/186 A |
| 4,304,406 | 12/1981 | Cromarty | 273/186 R |
| 4,456,257 | 6/1984 | Perkins | 273/186 R |
| 4,542,906 | 9/1985 | Takase et al. | 273/185 R |

*Primary Examiner*—George J. Marlo

*Attorney, Agent, or Firm*—Burns, Doane, Swecker & Mathis

[57] ABSTRACT

A practice golf club having a laterally curvable shaft with a head member attached to the end of the shaft and made of a resilient material. The shaft is preferably made of an elastomeric material such as neoprene. The other end of the shaft has a grip member which may be positioned along the length of the shaft to simulate various club lengths.

1 Claim, 4 Drawing Sheets

Fig. 5
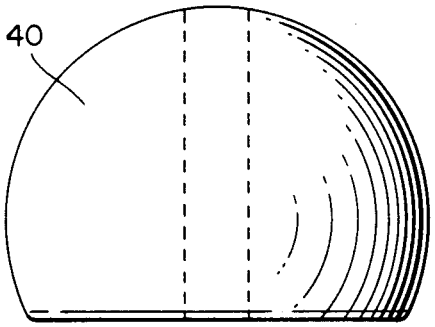
Fig. 7
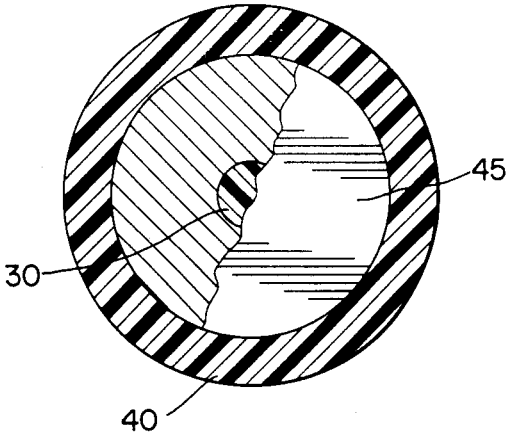
Fig. 6
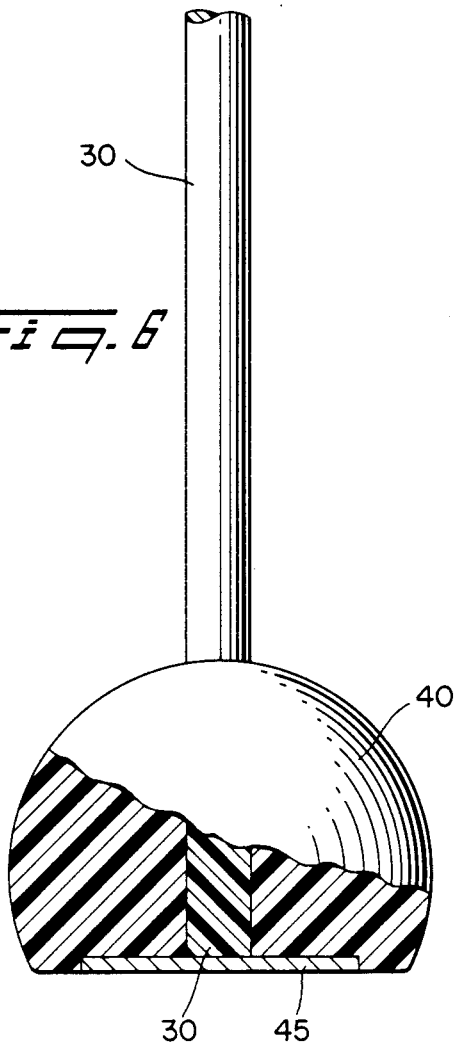
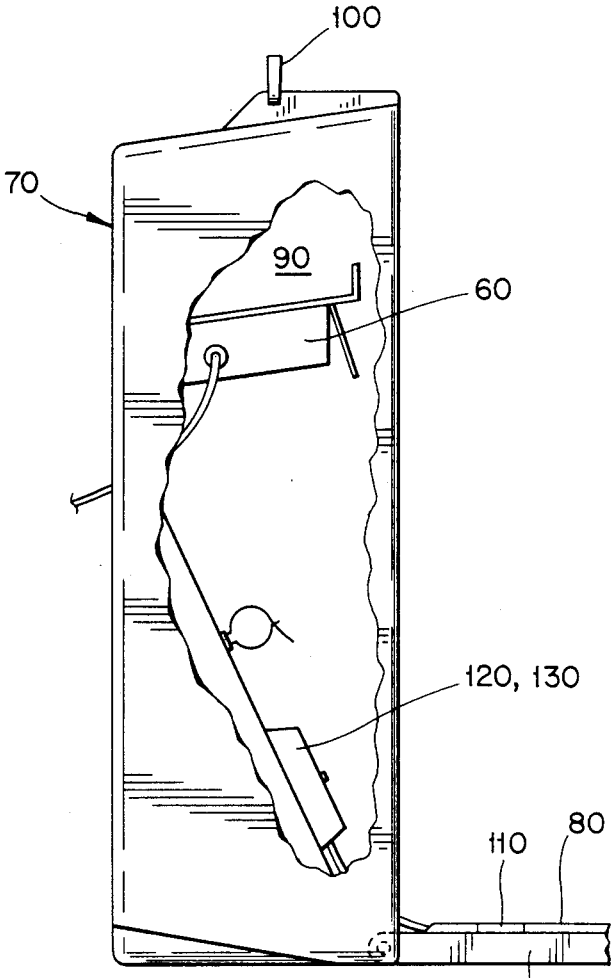
Fig. 8

GOLF CLUB SWING TRAINING DEVICE

BACKGROUND OF THE INVENTION

1. Field of the Invention

The present invention relates to apparatus for teaching or improving the swinging of a sports implement, and more particularly, to an apparatus for teaching or refining the skill of swinging a golf club.

2. Background Art

The art is replete with devices and techniques for improving the swinging of a golf club. These prior art devices and techniques fail to take into account, however, that the golf swing is a composite of hundreds of properly timed body movements, instead isolating and emphasizing certain aspects to the exclusion of others. Such emphasis on isolated aspects of the swinging of the golf club while ignoring others is as likely to inhibit a better swing as it is to promote it.

For example, a technique which focuses exclusively on stance while ignoring other factors such as balance, hand position, hip turn, shoulder turn, wrist break, leg movement, leg drive, and arm extension cannot promote a superior overall swing.

Another complicating factor is the tendency of the golfer to mistakenly associate force rather than velocity with distance. It is this perception which leads the golfer to us a golf club in a striking manner rather than in the swinging manner for which it was designed.

It is thus desirable to provide a golf training apparatus in which the user swinging a club member can instantly feel whether the proper coordination of all the above-stated aspects has been achieved. In the same vein, it is desirable that the apparatus be "unforgiving", that is, that it if proper coordination is not achieved, the feel and mechanics of the club swing should be dramatically different from what is experienced when the swing is within an optimal range.

One effort in this direction is disclosed in U.S. Pat. No. 3,229,980 to Silberman. Silberman discloses a golf swing training device that uses a completely flexible rope for the shaft. The idea behind the invention of Silberman is that unless the club device is swung properly, it can hardly be swung at all, that is, the shaft does not "help" the golfer position the head, and the head must instead be forced into travelling the desired arc by proper timing alone. While Silberman is a step in the right direction, the club implement described therein is too unforgiving, and, in fact, is so far divorced from the characteristics of a regulation golf club that it may be difficult to transfer the "feel" of properly swinging the Silberman implement to the "feel" of properly swinging a regulation golf club.

In addition to feel, it is also desirable to give the person desiring to learn or play better golf an improved visual indication of club head path as the club head traverses the region where a ball is struck during play. In this regard, U.S. Pat. No. 3,649,029 to Worrell discloses a golf practice apparatus that uses a luminescent pattern on a golf practice surface. Worrell, however, contains no appreciation of the possible advantages of applying such concepts to a practice implement having a shaft with special mechanical characteristics.

SUMMARY OF THE INVENTION

The present invention resides in a device designed to give an improved "feel" while at the same time retaining the advantage that the club device cannot be swung properly unless all the various aspects of the swinging of the golf club are properly coordinated.

Another aspect of the invention resides in providing an improved visual indication of proper swing path. This visual information, coupled with the motor feedback received from the muscles, reinforces and enhances the recognition of the "proper swing."

In another aspect of the invention, a speed sensor is provided to give the user an indication of speed of the club head as it traverses the region in which the ball would be struck during play. The speed indication provided by these means gives the user immediate positive reinforcement that in fact the club head is attaining desired velocities despite the fact that there is no rigid physical link between the club head and grip.

BRIEF DESCRIPTION OF THE DRAWINGS

These and other features and advantages of the invention will be readily apparent to one of ordinary skill in the art from the following written description, read in conjunction with the drawings, in which:

FIG. 5 is a diagrammatic view of a head member according to a presently preferred embodiment of the present invention;

FIG. 6 is a partially cut-away view of a preferred embodiment of a head member according to the present invention at it would be attached to a shaft member;

FIG. 7 is a bottom view of the head member of FIG. 6;

FIG. 8 is a partially cutaway side view of a case means including an ultraviolet light source, target swing path indicating means, and speed sensing means according to a presently preferred embodiment of the present invention;

DETAILED DESCRIPTION OF THE PREFERRED EMBODIMENTS

Figure 1:
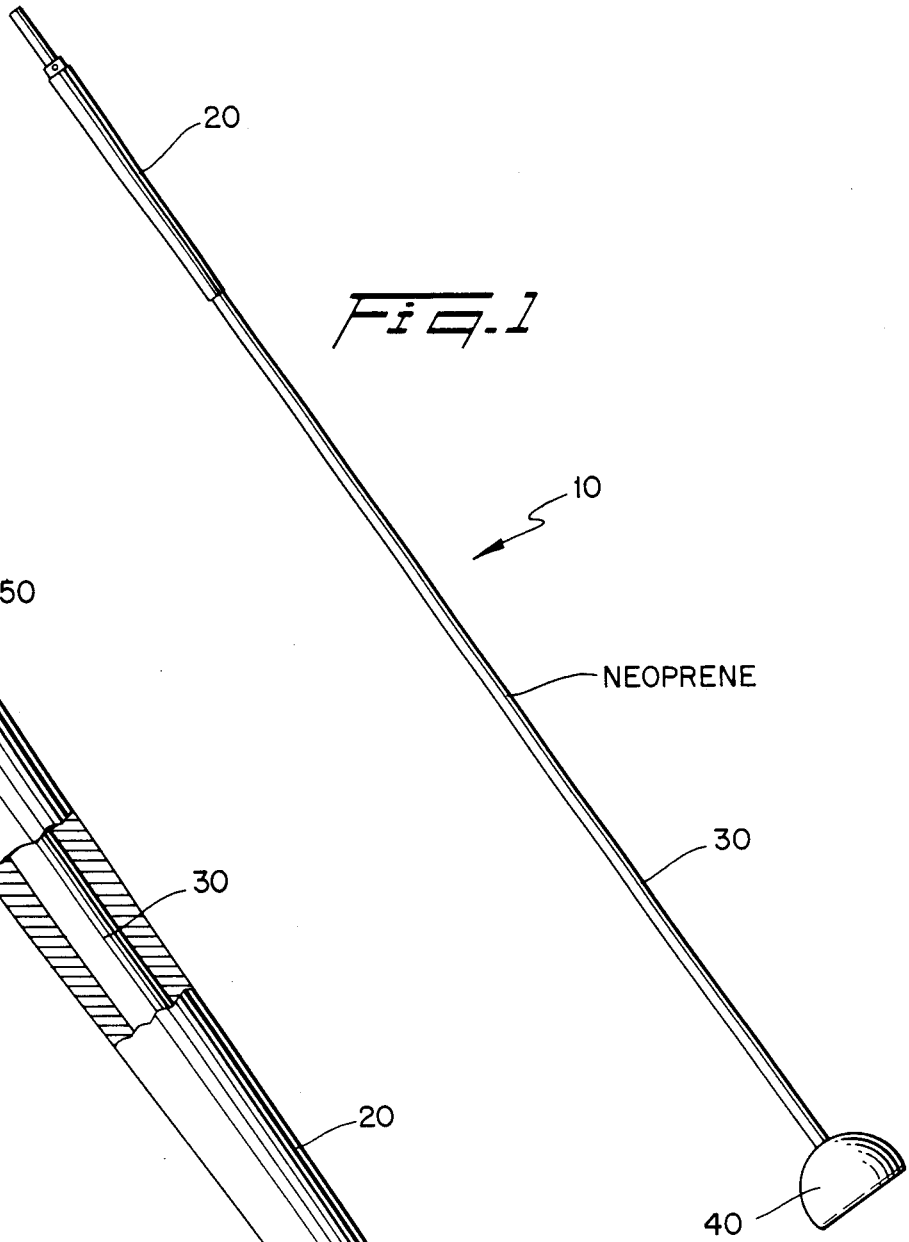
FIG. 1 is a diagrammatic view of a club member according to a presently preferred embodiment of the present invention.

Referring to FIG. 1, a golf training apparatus according to the present invention includes a club member 10 which in turn includes a grip member 20, an elongate shaft member 30, and a head member 40.

The elongate shaft member 30 is made of a material which is laterally curvable and lengthwise substantially inextensible. The term "curvable" is used here and in the claims to connote significantly more flexibility than found in a regulation golf shaft, but less flexibility than exhibited by completely flexible materials, such as a rope, which may be bent or even crimped at an angle. In contrast to the latter, the material for the shaft member 30 exhibits a minimum radius of curvature and cannot be bent or crimped without the use of excessive force.

In a presently preferred embodiment of the invention, the shaft member is made of an elastomeric material having hardness in the range of 60 to 80 durometer and having a diameter in the range of 0.375 to 0.625 inches. Specifically, in the present invention, the shaft member is preferably made of neoprene which is commercially available as an o-ring material within the diameter and hardness ranges specified. It has been found that a shaft made of this material gives a very realistic "feel" which can be readily translated into the feel which one gets from a semiflexible golf shaft. This material has a weight per unit length in the range of about 1 to 2.6 ounces per linear foot.

Another preferred characteristic of the material for shaft member 30 is that it be substantially longitudinally inextensible. This also makes it closer in character to a regulation golf club, making it more natural to transfer conditioning with the club member to actual play.

Figure 2:
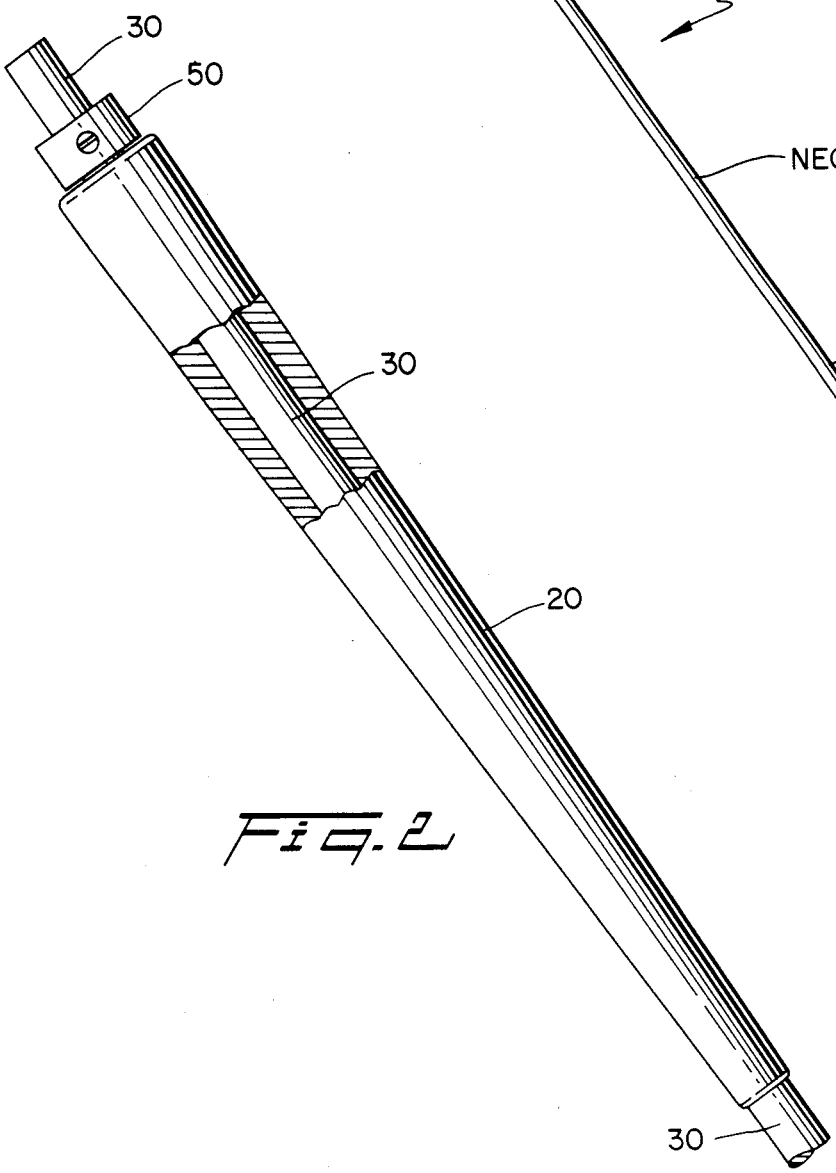
FIG. 2 is a partially cut-away view of a grip member according to a presently preferred embodiment of the present invention.
Figure 3:
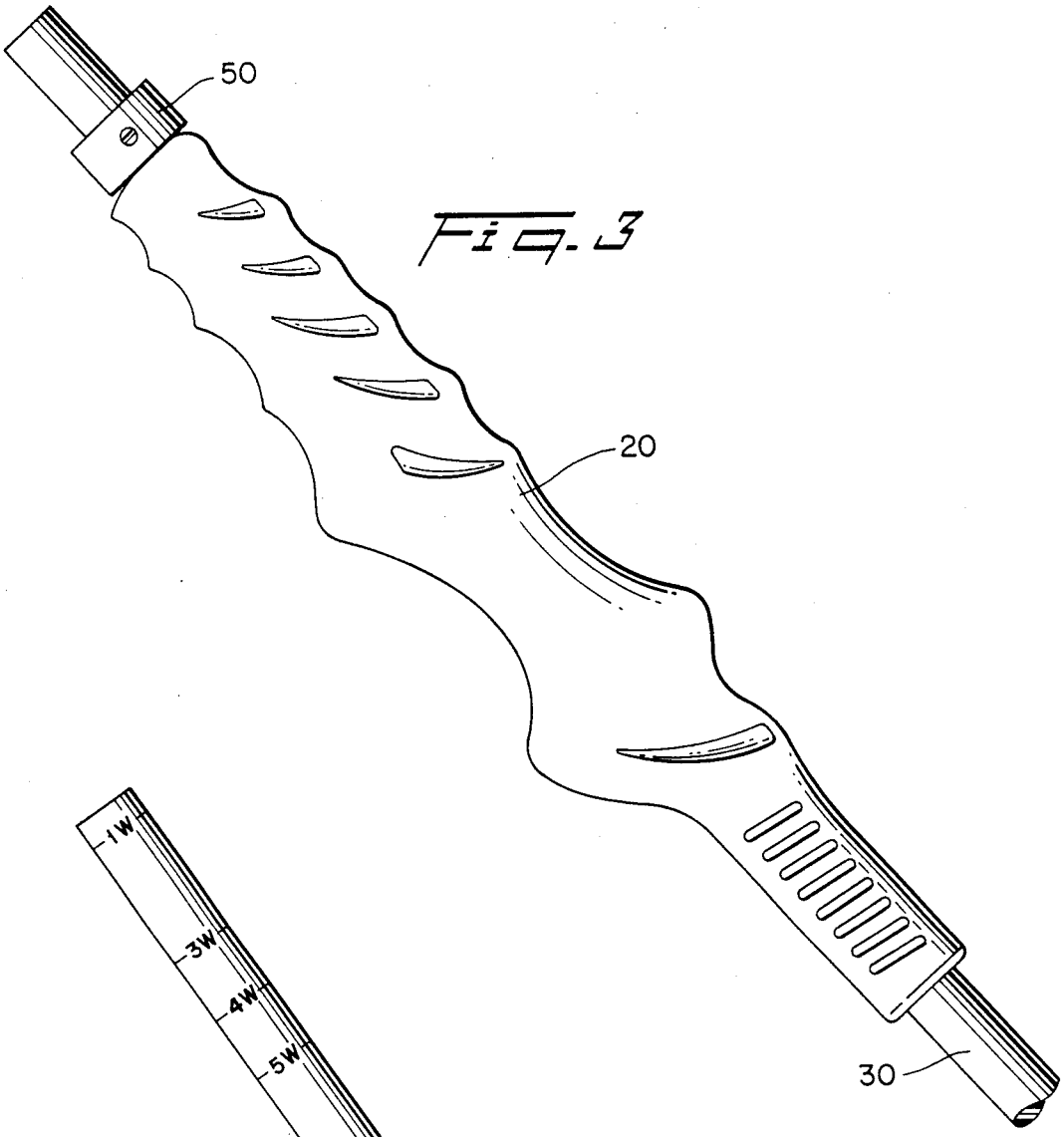
FIG. 3 is a partially cut-away view of an alternative grip member according to a presently preferred embodiment of the present invention.

The grip member is shown more clearly in FIG. 2. In the embodiment shown, the grip member resembles a grip of a regulation golf club. As shown in FIG. 3, however, the grip can also be configured as a training grip. It is desirable for either of these grips to be laterally flexible, that is, to be able to move from side to side. This forces the golfer to use the force of his own muscles to keep his hands in the proper relative positions, rather than relying upon the rigidity of the grip to achieve this. This is in keeping with the general philosophy behind the implement, that it not "help" the golfer but instead forces the golfer to properly coordinate the swing on his or her own.

As shown in FIG. 2, the grip member 20 is hollow, and so able to receive in its interior the elongate shaft member 30. A retaining ring 50 is then placed on the shaft member 30 to prevent the grip member 20 from slipping backward off of the shaft.

Figure 4:
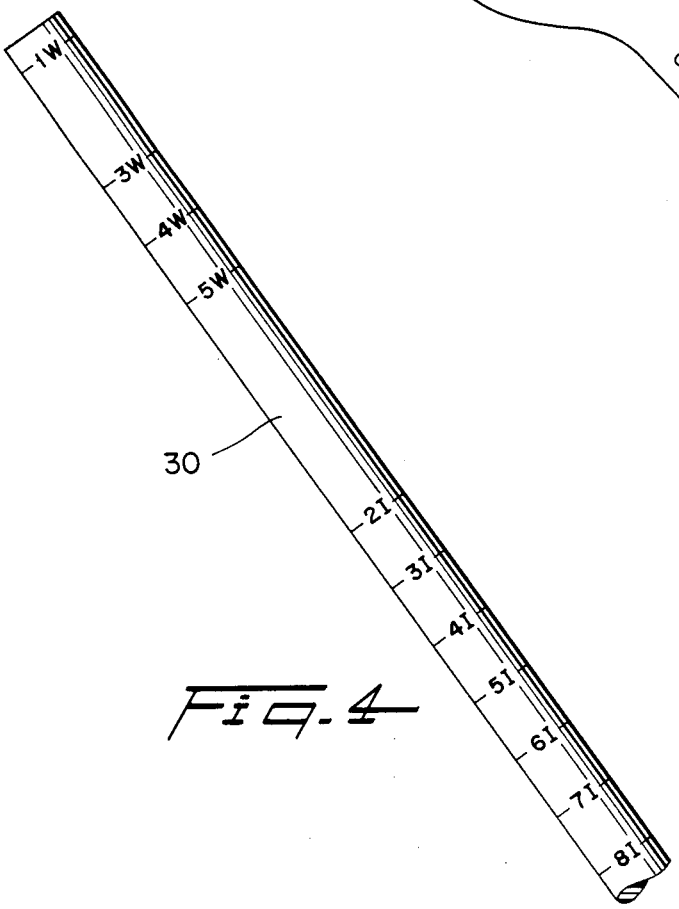
FIG. 4 is a partial view of shaft member markings for one end of a shaft member according to a presently preferred embodiment of the present invention.

As shown in FIG. 4, the portion of the shaft member 30 which receives the grip member 20 is preferably provided with a series of longitudinally displaced markings. These markings indicate the longitudinal positioning of the grip member 20 on the shaft member 30 to provide a distance between the grip member 20 and head member 40 along shaft member 30 corresponding to the distances between the grip and head along the shaft on various regulation golf clubs. Thus, the marking "1W" corresponds to where the end of the grip member 20 should be positioned to simulate the distance between grip and head of a No. 1 wood. Similarly, the marking "2I" indicates the positioning of the grip member 20 to simulate the distance between grip and head of a No. 2 iron.

The head member 40 is shown in a lateral cross-section in FIG. 5. It is desirable for head member 40 to have a weight selected to contribute to a realistic feel while swinging the golf club head. It is further desirable that the head member 40 be resilient so as to reduce the risk of property damage or personal injury during a practice session. It should also be configured to have a large optical cross-section when viewed by the swinger, and provided with a surface treatment to make it as highly visible as possible.

In the present invention, these goals are met through the provision of a head member made out of a lightweight resilient material, such as polyurethane foam. The foam is configured as a hemisphere, with the shaft entering into the hemisphere along the hemispherical axis of symmetry. As shown in FIG. 6, the head member 40 may be provided with a metallic plate 45 useful in conjunction with a speed sensor to be described below. According to a presently preferred embodiment of the invention, the head member 40 is painted a fluorescent color such as fluorescent yellow.

Figure 9:
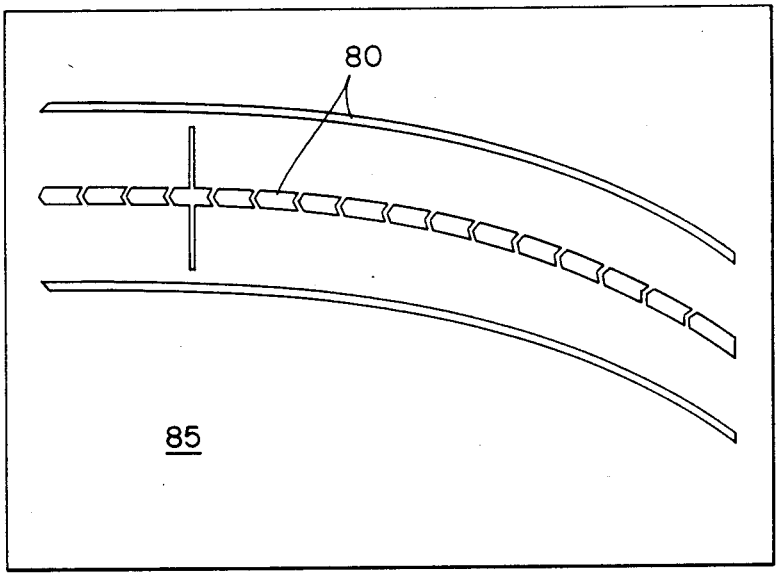
FIG. 9 is a plan view of means for indicating a target swing path according to a preferred embodiment of the present invention.

The advantages of the fluorescent characteristics of the coloration of the head member 40 are maximized if the head member 40 can be exposed to ultraviolet light while it traverses the region which would normally encounter a ball. Towards this end, there is shown in FIG. 8, a source of ultraviolet radiation 60. In the presently preferred embodiment, this source of ultraviolet radiation 60 is enclosed in case means 70. Case means 70 has a hinged lid 75. On the inner surface of this hinged lid there is disposed means 80 for indicating a target swing path, shown in FIG. 9. This means includes a mat 85 having guide marks indicating a proper swing path. As shown, these guide marks trace an inside-out swing path which is presently preferred as a more natural swing path as opposed to the more traditional straight swing path.

In the presently preferred embodiment, the ultraviolet light source 60 illuminates the means for indicating target swing path 80 and also the club head member 40 as it passes above the means for indicating target swing path 80. Thus, the user is given an extremely visible indication of the head member's 40 path.

As shown, the case means 70 preferably also includes a storage compartment 90 and a handle 100 to facilitate use of the case means not only as a support for the source of ultraviolet radiation 60 but as a carrying case for the club member 10 as well. Thus, considered together, this particular embodiment forms a compact and easily transported unit.

In another aspect of the presently preferred embodiment of the invention, the inner surface of the lid 75 is also provided with a speed sensor 110. In the presently preferred embodiment of the invention, this speed sensor 110 is in the form of a flat coil sensor. Such a sensor is available from a number of suppliers, including model number MITSUBISHI #M78704321. Metallic plate 45 is preferably incorporated in the head member 40 to increase the sensor's accuracy and reliability.

Figure 10:
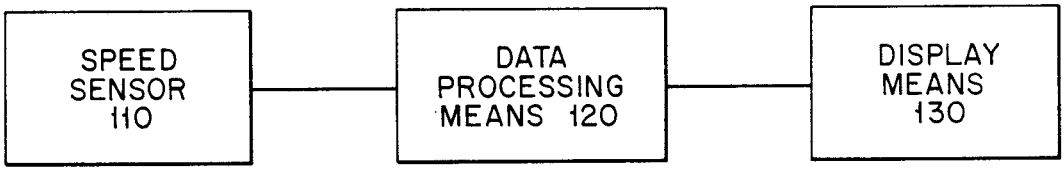
FIG. 10 is a functional block diagram of a speed sensing means according to the present invention.
Figure 11:
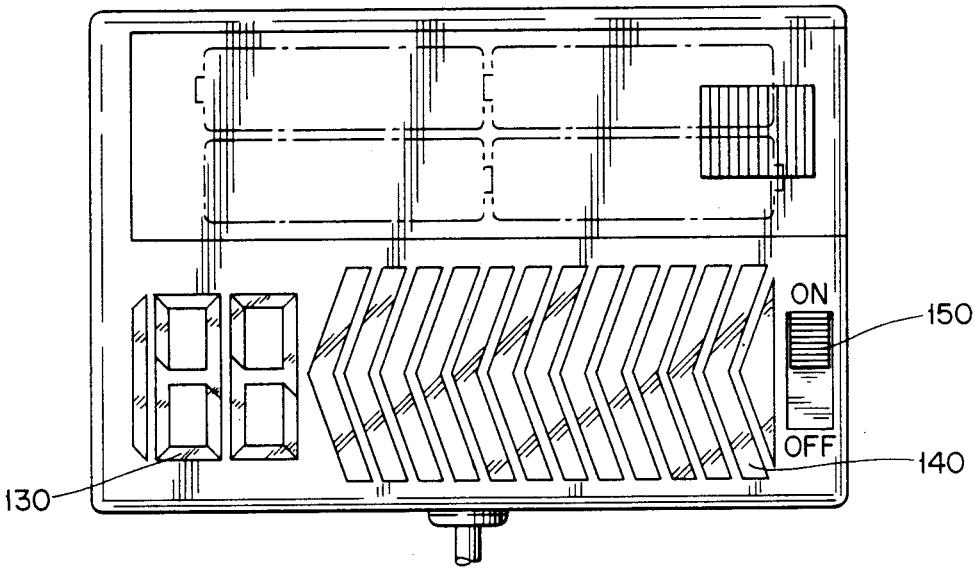
FIG. 11 is a plan view of a speed sensor according to a preferred embodiment of the present invention.

This speed sensor 110 senses the movement of the club head member 40 as it passes in proximity above the target path indicating means 80 to produce a signal which is fed to a data processing means 120, shown diagrammatically in FIG. 10. This data processing means in turn provides a signal to display means 130. A presently preferred embodiment of the display means 130 is shown in FIG. 11. It includes a numerical indicator 135 as well as a graphic speed display means 140. The unit may also be supplied with an ON/OFF switch 150 and can be powered by batteries shown in phantom.

The invention has been described in terms of specific embodiments to facilitate understanding. The above embodiments, however, are illustrative rather than limitative. It will be readily apparent to one of ordinary skill in the art that departures may be made from the specific embodiments shown above without departing from the essential spirit and scope of the invention. Therefore, the invention should not be regarded as being limited to the above examples, but should be regarded instead as being fully commensurate in scope with the following claims.

What is claimed is:

1. A golf swing training apparatus comprising a club member, said member including:

an elongate shaft member which is substantially uncrimpable, and lengthwise substantially inextensible and laterally curvable to provide significantly more flexibility than a regulation golf club shaft, but less flexibility than exhibited by completely flexible materials such as rope, which may be severely bent or crimped:

a head member attached to one end of said shaft member said head member being made of resilient material which reduces the risk of property damage or personal injury during a training session; and a grip member attached to the other end of said elongate shaft member, means for adjustably positioning and holding said grip member at different locations lengthwise on said shaft member between said grip member and said head member to effectively provide different shaft lengths corresponding to those found in conventional sets of numbered woods and irons.

* * * * *